US005342176A

United States Patent [19]

Redlich

[11] Patent Number: 5,342,176

[45] Date of Patent: Aug. 30, 1994

[54] METHOD AND APPARATUS FOR MEASURING PISTON POSITION IN A FREE PISTON COMPRESSOR

[75] Inventor: Robert W. Redlich, Athens, Ohio

[73] Assignee: Sunpower, Inc., Athens, Ohio

[21] Appl. No.: 42,662

[22] Filed: Apr. 5, 1993

[51] Int. Cl.[5] ..... F04B 49/00

[52] U.S. Cl. ..... 417/212; 60/431; 92/13; 92/60.5; 318/687; 417/44 J; 417/417

[58] Field of Search ..... 92/5 R, 13.1, 13.7, 92/60.5; 60/431; 417/44 J, 417, 212; 318/687

[56] References Cited

U.S. PATENT DOCUMENTS 4,772,838 9/1988 Maresca ..... 318/687

4,966,533 10/1990 Uchida et al. ..... 417/417

*Primary Examiner*—Edward K. Look
*Assistant Examiner*—F. Daniel Lopez
*Attorney, Agent, or Firm*—Frank H. Foster

[57] ABSTRACT

A method of measuring the distance at closest approach between the piston of a free piston compressor and the cylinder head. The method derives measurements of both the alternating and average components of piston position from direct measurements of the voltage and current applied to the linear permanent magnet motor that drives the piston, and thus eliminates any requirement for an additional position sensor located within the compressor.

4 Claims, 4 Drawing Sheets

METHOD AND APPARATUS FOR MEASURING PISTON POSITION IN A FREE PISTON COMPRESSOR

TECHNICAL FIELD

This invention relates generally to electronic metering and sensing, and more particularly relates to sensing the position of a reciprocating piston in a compressor used in refrigeration.

BACKGROUND ART

Compressors, in particular refrigerator compressors, are usually driven by conventional rotary electric motors and a crank mechanism. Resulting high side forces on the compressor piston require oil lubrication of the piston-cylinder interface. Thus, the refrigerant must be compatible with oil and there is appreciable power loss from friction in the mechanism. In the search for refrigerants to replace ozone depleting CFCs, oil compatibility is a substantial restriction.

Friction losses in the conventional crank mechanism waste energy. It is therefore advantageous to drive the compressor piston with a linear motion motor, which eliminates crank mechanisms and reduces side forces on the piston to a very low value, thereby eliminating the need for oil and making possible the use of gas bearings for the piston cylinder interface. Gas bearings have very low frictional power loss and practically no wear. The advent of high efficiency permanent magnet linear motors, such as the design disclosed in U.S. Pat. No. 4,602,174, makes the replacement of rotary motors by linear motors in a compressor economically feasible. However, such replacement poses a problem because if it is done, the rigid restraint on piston motion imposed by a crank mechanism no longer exists. The linearly reciprocating device has no inherent limits except collision of the reciprocating part with a stationary part.

A compressor piston driven by a linear motor will take up an average position that depends on the gas forces acting on the piston, and will reciprocate around the average position. As gas forces change, both the average component of position and the alternating component of position may change. Without some means of detecting the piston position and using the detected position in a feedback loop that controls the voltage applied to the motor, it is possible for the piston to hit the cylinder head, thus generating objectionable noise and possibly damaging the compressor. Another compelling reason for measuring piston position is that such measurement can be used to control the flow rate of mass pumped through the compressor in response to changing demands. In a refrigerator compressor, control of flow rate in response to changing ambient temperature can significantly improve the thermodynamic efficiency of the refrigeration cycle.

For purposes of preventing piston-cylinder head collisions and controlling mass flow rate through the compressor, one particular piston location is especially significant, namely the piston's location at its closest approach to the cylinder head. This special location can be determined by many types of position sensors, for example, optical detectors or proximity sensors based on eddy current generation. Use of such sensors would add to cost, could degrade reliability, and would create significant installation problems, particularly the need to bring several wires out through the wall of a pressure vessel in the case of refrigerator compressors.

The present invention is a method of measuring piston position at closest approach to the cylinder head without such an added sensor. It uses measurements of motor voltage and current made outside the compressor, as inputs to a digital or analog computation device to determine the piston position on closest approach based on known linear motor properties and known dynamics of piston motion.

BRIEF DISCLOSURE OF INVENTION

By analog or digital computation, piston velocity is computed from measurements of voltage applied to the motor and electrical current through the motor, the computation being based on known properties of the linear motor.

The alternating component of piston displacement from a fixed reference position is derived from piston velocity by analog or digital integration. The average piston displacement is not recovered by this computation.

Average component of piston displacement is computed from simultaneously sampled values of motor current, alternating component of piston position, and piston acceleration. This computation is based on the known dynamics of piston motion. Piston acceleration is derived from piston velocity by analog or digital differentiation.

To determine the piston displacement at closest approach of the piston to the head, average piston displacement is added to the value of the alternating component of piston displacement at closest approach, this value being obtained by sampling the alternating component of piston position when the piston is at top dead center, that is, when piston velocity is zero and is changing in direction from towards the head to away from the head.

Figure 1:
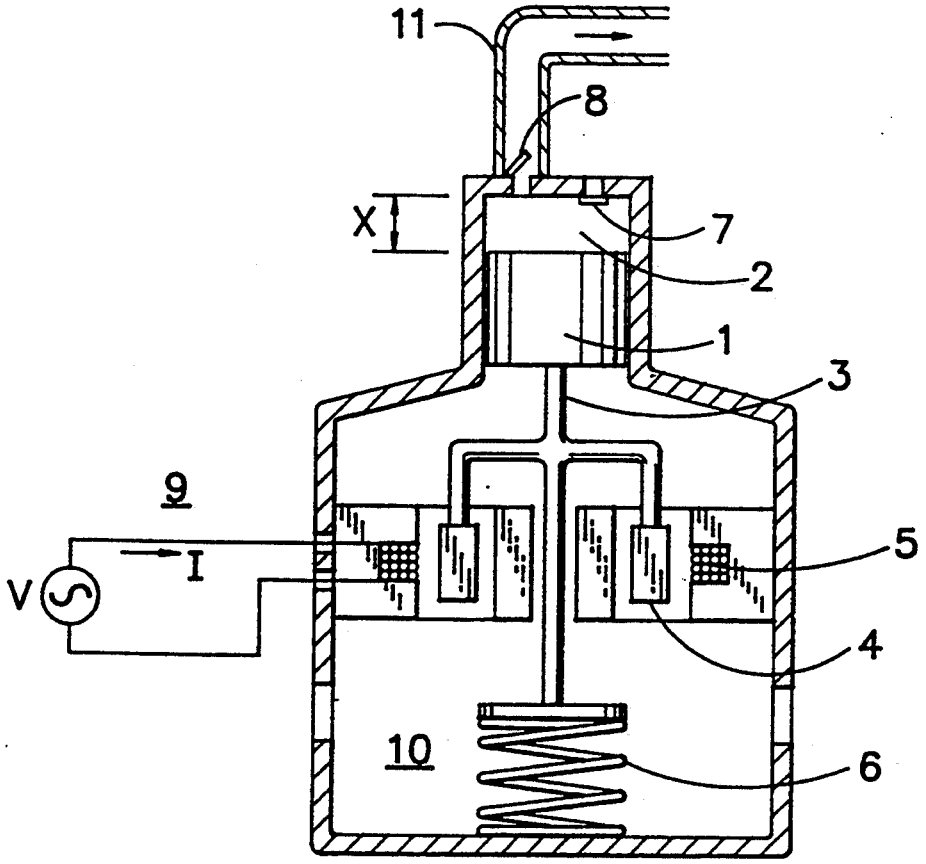
FIG. 1 is a cross-sectional view of a free piston compressor driven by a permanent magnet linear motion electric motor.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

In FIG. 1, piston 1 reciprocates in cylinder 2 in response to forces on magnets 4 to which the piston is connected by yoke 3. The forces on the magnets are caused by magnetic fields set up by current I in winding 5. Piston motion is transmitted by the yoke linking the piston 1 to spring 6, which has a spring constant K, expressed in newtons per meter.

During downward piston motion, gas or vapor at "suction pressure", which is the pressure in the surrounding space 9 and also in the lower part of the compressor interior space 10, is drawn into the cylinder through check valve 7. During upward motion of the piston, gas or vapor is initially compressed until the pressure in the cylinder exceeds the "discharge pressure", that is, the pressure in discharge pipe 11, at which point check valve 8 opens and gas or vapor is pushed into the discharge pipe by continuing upward motion of the piston.

The upper face of the piston is subjected to a time varying pressure force which generally does not average out to zero over a reciprocation cycle, since the pressure is high during compression and discharge and low during suction and intake. Average pressure force on the piston is counteracted by an equal, opposite spring force caused by an average compression of spring 6. Therefore, when an alternating voltage V is applied to the terminals of winding 5, the piston reciprocates around an average position determined by gas forces and K.

The main purpose of the invention is to measure the piston location relative to a fixed point on the cylinder when the piston is at top dead center, that is, at its smallest separation from the cylinder head. To accomplish this, the average component of piston displacement must be measured and added to the alternating component at top dead center. A further purpose of the invention is to accomplish its main purpose using only measurements of linear motor voltage V and current I.

Figure 2:
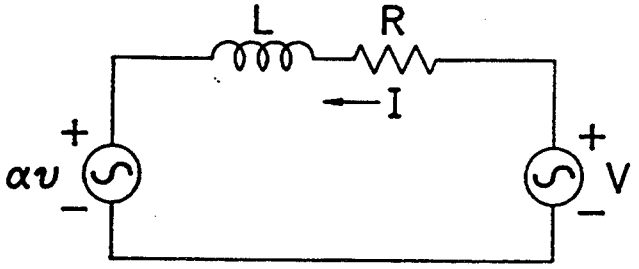
FIG. 2 is the equivalent electrical circuit of a permanent magnet linear motion electric motor.

The first step in the measurement process according to the invention is to determine piston velocity, which will be denoted by v, from signals proportional to V and I and a computation based on the equivalent circuit of the linear motor as shown in FIG. 2. Associated with the linear motor is an electro-mechanical transfer constant, which will be denoted by $\alpha$, that expresses either the voltage induced in winding 5 per unit of piston velocity v or the force exerted on magnets 4 per unit of I. The units of $\alpha$ are volt seconds/meter or newtons-/ampere, which can be shown to be identical from the defining units of voltage, which are (newton meters)-/(ampere second).

In FIG. 2, L is the inductance of winding 5 and R is its resistance. The equivalent circuit follows from the definition of $\alpha$ and Kirchoff's rules for electrical circuits. According to the equivalent circuit, $$v=(1/\alpha)(V-L(dI/dt)-IR). \quad (1)$$

Since $\alpha$, L, and R are known quantities for a particular motor, v can be determined from equation (1) and signals proportional to V and I by conventional analog or digital computation. From v, the alternating component of piston displacement, which will be denoted by x, can be found by conventional analog or digital integration according to the following equation, $$x=\int v\,dt. \quad (2)$$

Integration according to equation (2) cannot recover the average component of piston displacement because all practical analog or digital integrators differ from a perfect integrator in their response to a constant, or DC, input. A perfect integrator ramps up to infinite output with any DC input, no matter how small, while a practical integrator must have limited DC response in order to prevent saturation of its output by unavoidable small DC offset voltages.

The response of a practical integrator to an input signal proportional to v is the sum of its response to the alternating component of v, which response is x, and its response to a transient component of v which occurs only while the piston is moving towards its eventual average position. It can be shown from signal processing theory that the latter response approaches zero and becomes negligible within a typical time interval of about ½ second. After this time interval, the response of a practical integrator to a signal proportional to v will be a signal proportional to x, i.e., to the reciprocating component of displacement only. Therefore, an essential and novel part of the invention is a method of recovering the average component of piston displacement from measurements of V and I.

According to the invention, the average component of piston displacement, which will be denoted by $X_{av}$, can be found from a computation based on the equation of motion of the piston during the suction phase of the compressor cycle, i.e., while suction pressure exists on both sides of the piston and the only forces acting on the piston are spring force and force exerted on the magnets, which forces will be denoted by $F_s$ and $F_m$ respectively. These forces obey the following equations;

$$F_s=-K(x+X_{av}) \quad (3)$$

$$F_m=\alpha I. \quad (4)$$

Newton's law of motion states that, during the suction phase, $F_s$ plus Fm is equal to the total reciprocating mass multiplied by the acceleration of the piston. From that relation it then follows that, if $x_o$, $I_o$, and $A_o$ are values of x, I, and acceleration respectively, measured simultaneously at any time during the suction phase, and if M denotes total reciprocating mass, then;

$$X_{av}=-x_o+(\alpha/K)I_o-(M/K)A_o. \quad (5)$$

Acceleration required in equation (5) is found in the invention by conventional analog or digital differentiation of v, according to the following equation in which A denotes acceleration;

$$A=dv/dt \quad (6)$$

Piston displacement at top dead center, which will be denoted by $X_c$, is now found according to the invention by adding $X_{av}$ to the value of x at top dead center, which value will be denoted by $x_i$. The point in time when the piston reaches top dead center is that point when v equals zero and is changing direction from towards the cylinder head to away from the cylinder head. The equation for $X_c$ according to the invention is therefore as follows:

$$X_c=x_i-x_o+(\alpha/K)I_o-(M/K)A_o \quad (7)$$

$X_c$ in equation (7) is the displacement of any point on the piston from the location of the same point when the spring is neither compressed nor extended, measured when the piston is at top dead center.

Figure 3:
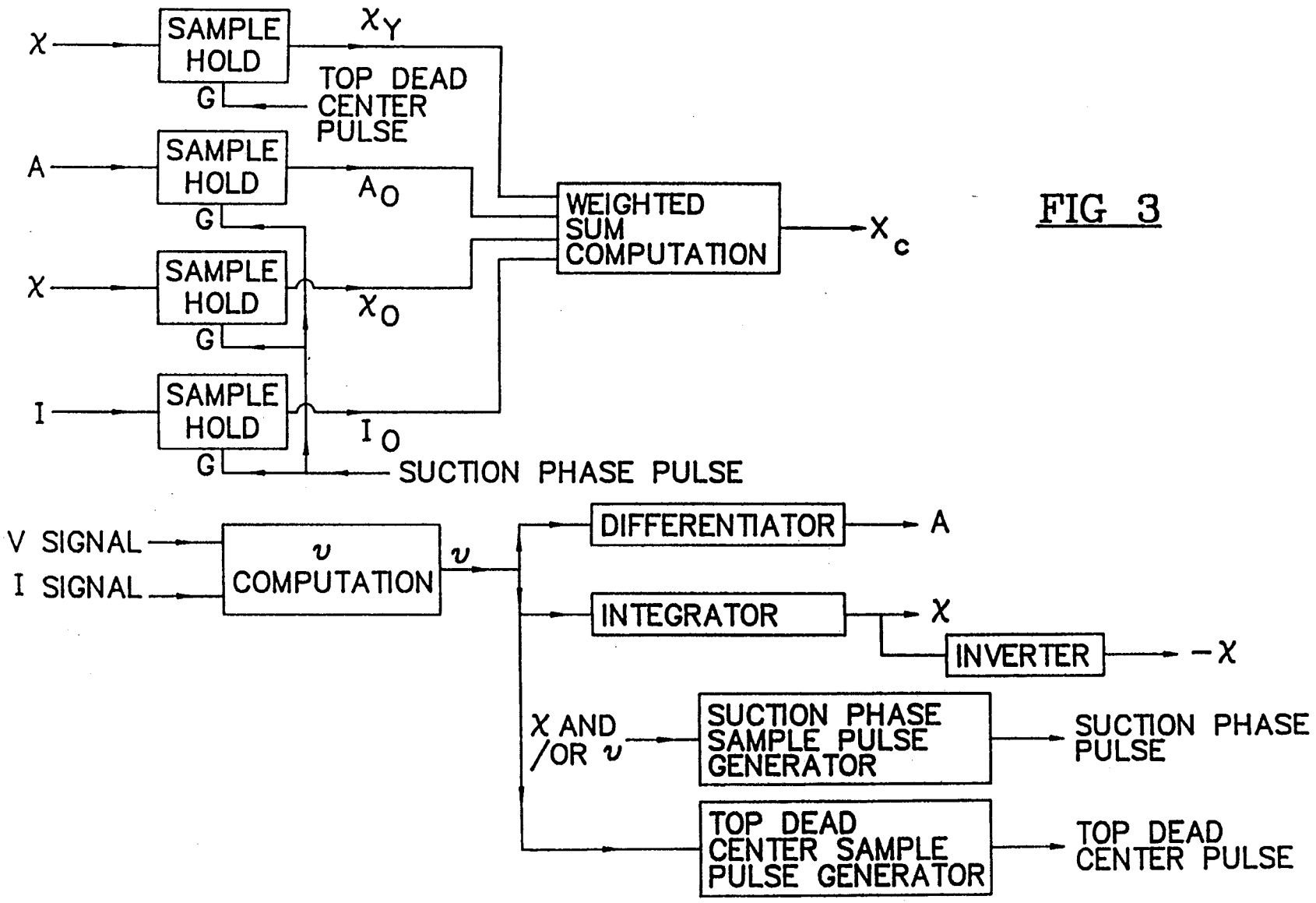
FIG. 3 is a block diagram of the invention.

FIG. 3 is a block diagram of the invention, in which signal flow direction is indicated by arrows and the subcircuits required by a preferred embodiment of the invention are indicated by titled blocks. Inputs proportional to V and I are labelled V signal and I signal respectively. The block labelled "v COMPUTATION" computes v according to equation (1). The blocks labelled "DIFFERENTIATOR" and "INTEGRATOR" compute A and x respectively from equations (6) and (2). The block labelled "TOP DEAD CENTER SAMPLE PULSE GENERATOR" has v as input and generates a pulse, using conventional techniques, when v is equal to zero and is changing direction from towards the cylinder head to away. The block labelled "SUCTION PHASE SAMPLE PULSE GENERATOR" has x and/or v as input and generates a pulse at some point in time during the suction phase, the exact point being determined by a combination of x and v. For example, v alone could be used as input and a pulse generated at bottom dead center when v is equal to zero and changing in direction from away from the cylinder head to towards it. Or x alone could be used as input and a pulse generated when x equals zero and v is away from the cylinder head, i.e., at the midpoint of the suction stroke. The four blocks labelled "SAMPLE HOLD" transfer the value of their input, which enters the block from the left, to the output at the right of the block, when a pulse is received at their "G" terminal. The output then maintains its value until another pulse arrives at G. Three of the sample hold circuits receive the same suction phase pulse. These three have inputs A, x, and I respectively and outputs $A_o$, $x_o$, $I_o$.

The fourth sample hold receives the top dead center sampling pulse and its input is x, hence its output is $x_i$. The block titled "WEIGHTED SUM COMPUTATION" takes the inputs $x_i$, $A_o$, $x_o$, $I_o$; inverts the sign of $X_o$, inverts $A_o$ and multiples it by (M/K), multiplies $I_o$ by ($\alpha$/K), and then computes $X_c$ by summing according to equation (7).

Figure 4:
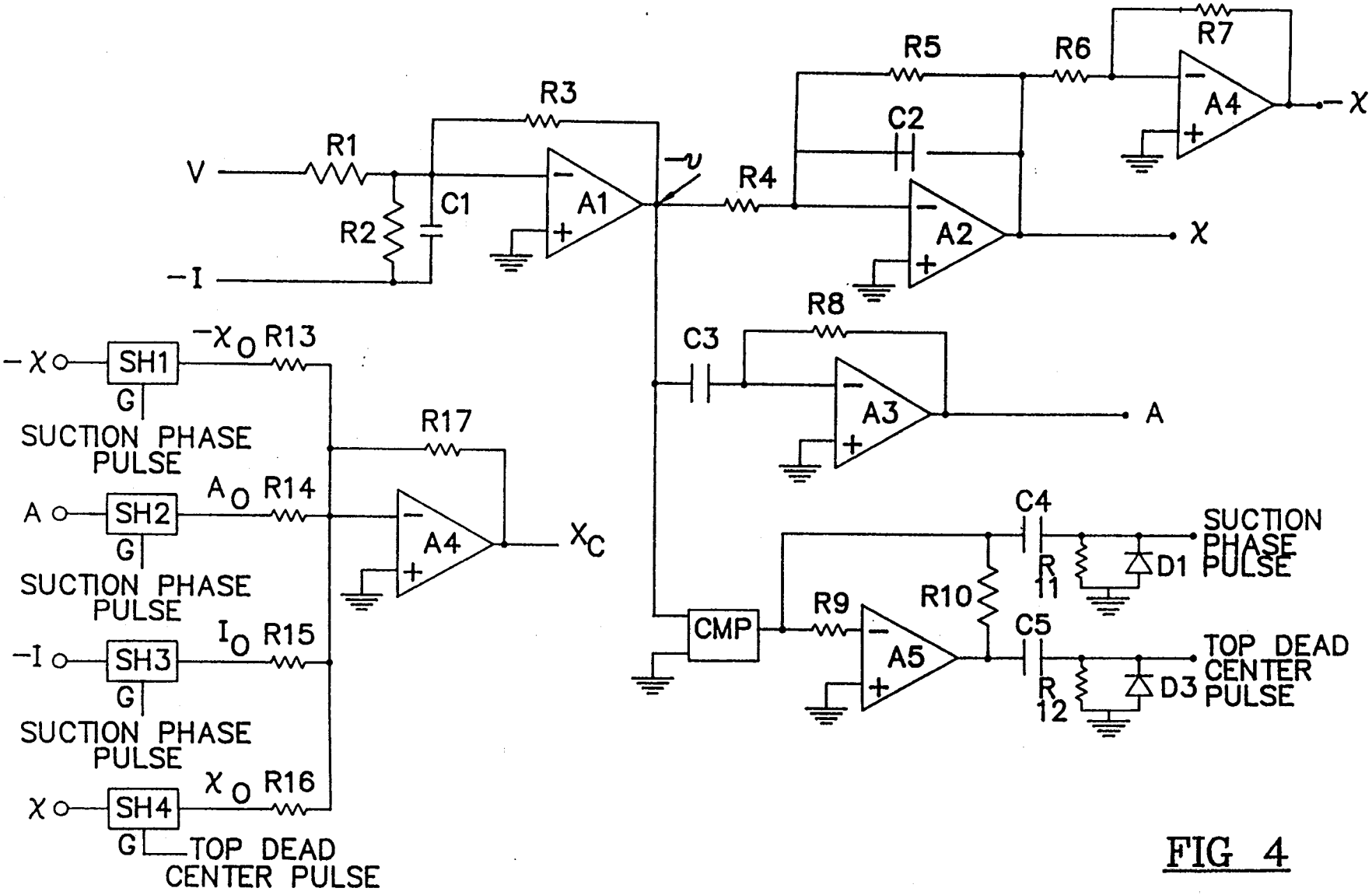
FIG. 4 is a schematic diagram of a particular embodiment of the invention using analog computation.

FIG. 4 shows a basic analog embodiment of the invention. A1 through A5 are operational amplifiers. A1, R1, R2, R3, and C1 perform conventional analog computation of v according to equation (1). A2, R5, and C2 form an analog integrator which computes x from v. The purpose of R5 is to limit the DC response of the analog integrator. A4, R6, and R7 invert x to generate −x. A3, C3, and R8 form a conventional analog differentiator which generates A from v. In this embodiment, the suction phase pulse is at bottom dead center, It is generated by first applying v to a comparator labelled CMP, which produces a square wave with zero crossings simultaneous with those of v. Differentiating network C4, R11 differentiates the comparator output, generating positive and negative pulses, at the zero crossings of CMP's output, and diode D1 eliminates the negative pulse. The top dead center pulse is similarly generated by first inverting CMP's output with A5, R9 and R10, and then forming a positive pulse with C5, R12, and D3. SH1 through SH4 are sample hold circuits with respective inputs −x, A, −I, and x, and respective outputs $-x_i$, $A_o$, $I_o$, and $x_o$. A4 and R13 through R17 perform the weighted summation of equation (7), weighting factors being determined by the values of R13 through R17. The voltage at the output of A4 is proportional to $X_c$.

Many variations are possible within the spirit of the invention. For example, a more precise equivalent circuit for the linear motor, which accounts for winding capacitance and change in loss resistance with frequency, may be used in the computation of v from V and I.

The actual values of data, voltages and currents in the circuits of the present invention will, in the conventional manner, not be identical to the values they represent in the equations and mathematical expressions used. Instead, they will be proportional to the actual values or otherwise related as is known to those skilled in the art.

Figure 5:
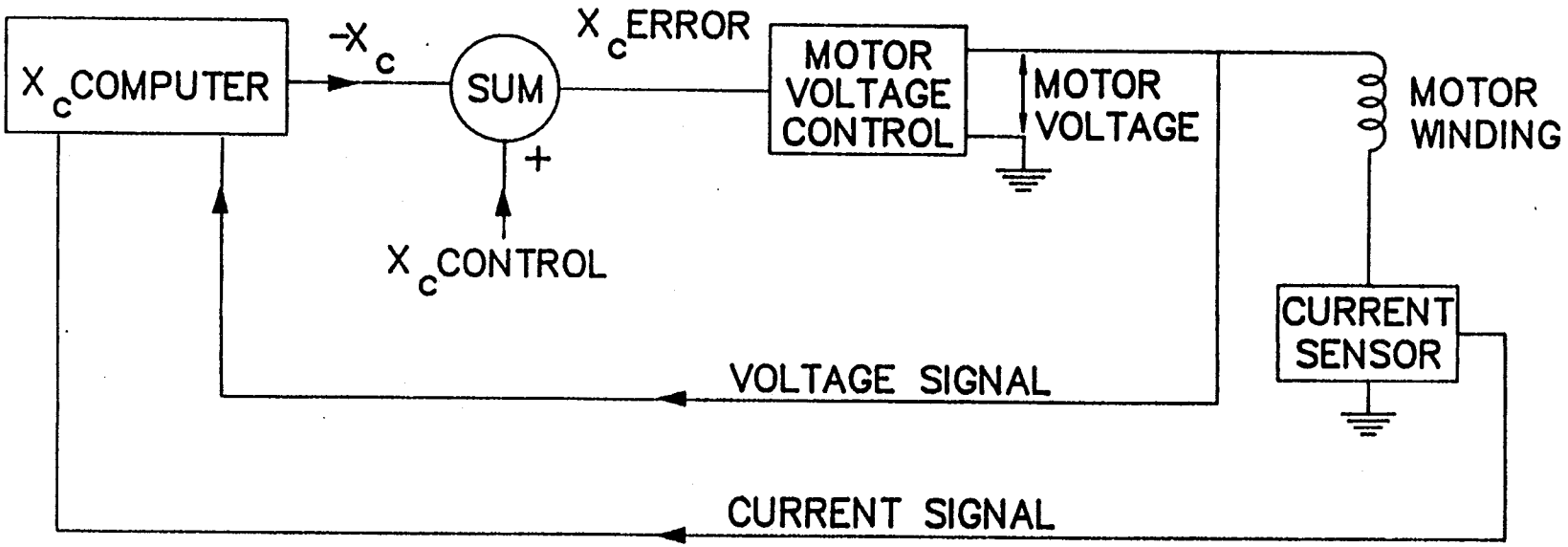
FIG. 5 is a block diagram illustrating how the invention can be used for automatic control of the top dead center position of a compressor piston.

FIG. 5 shows in block diagram form how the invention can be applied to automatic control of the top dead center position of the piston of a free piston compressor. A command signal labelled $X_c$ CONTROL is summed with an inverted $X_c$ signal obtained by computation according to the invention. The summed output is an error signal labelled $X_c$ ERROR, which is proportional to the difference between a required value of $X_c$ and the actual value of $X_c$. The error signal is used to change the voltage applied to the linear motor that drives the compressor, the direction of change being such as to reduce the error signal to a low value, thereby causing the actual value of $X_c$ to closely approximate the required value of $X_c$ as expressed by the command signal.

While certain preferred embodiments of the present invention have been disclosed in detail, it is to be understood that various modifications may be adopted without departing from the spirit of the invention or scope of the following claims.

I claim:

1. An improved gas or vapor compressor including a control apparatus and a free piston linked to a spring and reciprocating in a cylinder in alternating suction and pressure phases, the piston during reciprocation having an alternating component of displacement, a velocity, an acceleration and an end displacement of the piston's excursion in the cylinder, the piston being driven in reciprocation by an electromagnetic linear motor drivingly linked to the piston, the linear motor including a magnet and a winding having an associated resistance and inductance, the motor having input terminals and a characteristic electro/mechanical transfer constant, the motor being driven by an alternating voltage applied to and a current forced through the input terminals of the motor winding, wherein the improvement is a feedback control apparatus comprising:

(a) a voltage detector circuit connected to said winding input terminals for detecting the voltage applied to the winding as a function of time;

(b) a current detector circuit connected to said winding for detecting the current through the winding as a function of time;

(c) a command signal input for inputting a command signal representing a selected, required end displacement;

(d) a computing circuit generating a signal representing a measured value of said end displacement and comparing said measured value signal to said command signal to generate an error signal by:

(i) computing the velocity of the reciprocating piston as a function of time from the detected voltage and current in accordance with the equation:

$$v=(1/\alpha)(V-L(dI/dt)-IR);$$

wherein $\alpha$ is said transfer constant

V is said voltage

I is said current
R is said winding resistance
L is said winding inductance
t is time;

(ii) integrating the computed velocity as a function of time to compute the alternating component of displacement of said piston as a function of time;

(iii) differentiating the computed velocity as a function of time to compute the acceleration of the piston as a function of time;

(iv) detecting the alternating component of displacement resulting from step (ii) when the computed velocity is zero;

(v) simultaneously during said suction phase detecting the alternating component of displacement resulting from step (ii), the acceleration resulting from step (iii) and the current detected from said current detector;

(vi) computing the displacement of the reciprocating piston at the end of its excursion in accordance with the equation:

$$X_c = x_i - x_o + (\alpha/K)I_o - (M/K)A_o;$$

wherein:

$X_c$ is said end displacement
$x_i$ is the alternating displacement when the velocity is zero
$x_o$ is the simultaneously detected alternating displacement
$A_o$ is the simultaneously detected acceleration
$I_o$ is the simultaneously detected current
M is the mass of the reciprocating body
K is the spring constant of the spring;

(vii) comparing said command signal to the computed end displacement signal $X_c$ to generate an error signal; and (e) a motor voltage control circuit having an input connected to receive said error signal and having an output connected to said motor winding for changing the voltage applied to the motor winding in response to said error signal in a direction minimizing the error signal.

2. The apparatus in accordance with claim 1 wherein the apparatus further includes a plurality of sample and hold circuits for sampling said alternating component of displacement when the computed velocity is zero, and said simultaneously detected alternating component of displacement, acceleration and current.

3. A method for controlling a gas or vapor compressor having a free piston linked to a spring and reciprocating in a cylinder in alternating suction and pressure phases, the piston during reciprocation having an alternating component of displacement, a velocity, an acceleration and an end displacement of the piston's excursion in the cylinder, the piston being driven in reciprocation by an electromagnetic linear motor drivingly linked to the piston, the linear motor including a magnet and a winding having an associated resistance and inductance, the motor having input terminals and a characteristic electro/mechanical transfer constant, the motor being driven by an alternating voltage applied to and a current forced through the input terminals of the motor winding, the method comprising:

(a) detecting the voltage across the winding as a function of time;

(b) detecting the current through the winding as a function of time;

(c) inputting a command signal representing a selected, required end displacement;

(d) generating a signal representing a measured value of said end displacement and comparing said measured value signal to said command signal to generate an error signal by:

(i) computing the velocity of the reciprocating piston as a function of time from the detected voltage and current in accordance with the equation:

$$v = (1/\alpha)(V - L(dI/dt) - IR);$$

wherein $\alpha$ is said transfer constant
V is said voltage
I is said current
R is said winding resistance
L is said winding inductance
t is time;

(ii) integrating the computed velocity as a function of time to compute the alternating component of displacement of said piston as a function of time;

(iii) differentiating the computed velocity as a function of time to compute the acceleration of the piston as a function of time;

(iv) detecting the alternating component of displacement resulting from step (ii) when the computed velocity is zero;

(v) simultaneously during said suction phase detecting the alternating component of displacement resulting from step (ii), the acceleration resulting from step (iii) and the current detected from said current detector;

(vi) computing the displacement of the reciprocating piston at the end of its excursion in accordance with the equation:

$$X_c = x_i - x_o + (\alpha/K)I_o - (M/K)A_o;$$

wherein:

$X_c$ is said end displacement
$x_i$ is the alternating displacement when the velocity is zero
$x_o$ is the simultaneously detected alternating displacement
$A_o$ is the simultaneously detected acceleration
$I_o$ is the simultaneously detected current
M is the mass of the reciprocating body
K is the spring constant of the spring;

(vii) comparing said command signal to the computed end displacement signal $X_c$ to generate said error signal; and (e) changing the voltage applied to the motor winding in response to said error signal in a direction minimizing the error signal.

4. The method in accordance with claim 3 wherein the detecting of steps (d)(iv) and (d)(v) each comprise sampling the recited values at the recited times.

* * * * *